US008125419B2

(12) United States Patent
Takahashi

(10) Patent No.: US 8,125,419 B2
(45) Date of Patent: Feb. 28, 2012

(54) ELECTRO-OPTICAL DEVICE, METHOD FOR DRIVING ELECTRO-OPTICAL DEVICE, AND ELECTRONIC APPARATUS

(75) Inventor: Kasori Takahashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1090 days.

(21) Appl. No.: 11/734,035

(22) Filed: Apr. 11, 2007

(65) Prior Publication Data

US 2008/0042942 A1 Feb. 21, 2008

(30) Foreign Application Priority Data

Apr. 19, 2006 (JP) ..... 2006-115433

(51) Int. Cl.
*G09G 3/30* (2006.01)

(52) U.S. Cl. ..... 345/77; 345/89

(58) Field of Classification Search ..... 345/76–89, 345/94, 690, 204
See application file for complete search history.

(56) References Cited

U.S. PATENT DOCUMENTS

| | | | | |
|---|---|---|---|---|
| 7,230,594 | B2 * | 6/2007 | Miller et al. | 345/82 |
| 7,528,811 | B2 * | 5/2009 | Iwabuchi | 345/77 |
| 7,557,784 | B2 * | 7/2009 | Kwak et al. | 345/82 |
| 2003/0222840 | A1 | 12/2003 | Koga et al. | |
| 2005/0264496 | A1 * | 12/2005 | Shin | 345/76 |

FOREIGN PATENT DOCUMENTS

| | | | |
|---|---|---|---|
| JP | A 2003-255900 | | 9/2003 |
| JP | A 2004-037656 | | 2/2004 |
| JP | A 2004-184489 | | 7/2004 |
| JP | A 2004-341312 | | 12/2004 |
| JP | A 2004-341368 | | 12/2004 |
| JP | 2005148306 A | * | 6/2005 |
| JP | A-2005-148306 | | 6/2005 |
| JP | A 2006-284712 | | 10/2006 |

* cited by examiner

*Primary Examiner* — Kevin M Nguyen
*Assistant Examiner* — Kenneth B Lee, Jr.
(74) *Attorney, Agent, or Firm* — Oliff & Berridge, PLC

(57) ABSTRACT

An electro-optical device includes a unit circuit and a signal generating circuit. The unit circuit includes a first element section that controls a first electro-optical element to a gradation level corresponding to a level of a data signal, and a second element section that controls a second electro-optical element to a gradation level corresponding to a level of a data signal. When data signals having an identical level are applied to the first element section and the second element section, the gradation level of the first electro-optical element is lower than the gradation level of the second electro-optical element. The signal generating circuit generates data signals having different levels according to a gradation value specified for the unit circuit. When the gradation value is within a first gradation range, the signal generating circuit applies to the first element section a data signal whose level is determined so that the first electro-optical element is controlled to a gradation level corresponding to the gradation value. When the gradation value is within a second gradation range higher than the first gradation range, the signal generating circuit applies to the second element section a data signal whose level is determined so that the second electro-optical element is controlled to a gradation level corresponding to the gradation value.

10 Claims, 12 Drawing Sheets

ELECTRO-OPTICAL DEVICE, METHOD FOR DRIVING ELECTRO-OPTICAL DEVICE, AND ELECTRONIC APPARATUS

The entire disclosure of Japanese Application No. 2006-115433, filed Apr. 19, 2006 is expressly incorporated by reference herein.

BACKGROUND

1. Technical Field

The present invention relates to a technique for controlling gradation levels of electro-optical elements such as organic light emitting diode (OLED) elements.

2. Related Art

Electro-optical devices having multiple electro-optical elements have been proposed. Each of the electro-optical elements is controlled to a gradation level corresponding to the level (such as the voltage value or the current value) of a data signal output from a driving circuit. The driving circuit generates a data signal having a level corresponding to a gradation value D specified by image data. A characteristic curve $F_{C1}$ shown in FIG. 19 indicates the relationship between the voltage of the data signal and the gradation of the electro-optical elements (e.g., the brightness of the OLED elements).

JP-A-2003-255900 discloses a display device in which the relationship between a gradation value D and an actual gradation level of an electro-optical element is adjusted by a gamma correction. FIG. 20 is a graph showing the relationship between a gradation value D and a gradation level of an electro-optical element when the gamma value is set to 2.0.

There is a demand for an electro-optical device capable of multiple gradation display. However, the step width of levels of a data signal (that is, the minimum change amount) needs to be reduced to finely change the gradation of electro-optical elements. Therefore, a problem occurs in that a high-performance large-scale driving circuit is needed, resulting in an increase in the cost of the electro-optical device.

The above-described problem becomes noticeable when the luminous efficiency of the electro-optical elements increases. That is, as indicated by a characteristic curve $F_{C2}$ shown in FIG. 19, the change amount of the gradation of the electro-optical elements with respect to the level (e.g., the voltage value) of the data signal increases as the luminous efficiency of the electro-optical elements increases. Thus, if the gradation of the electro-optical elements changes by a value of ΔG shown in FIG. 19, it is necessary to improve the performance of the driving circuit so that a step width ΔV2 of levels of the data signal becomes smaller than a step width ΔV1 in the characteristic curve $F_{C1}$.

Further, in a case where the gamma correction is performed using a gamma value higher than 1, as shown in FIG. 20, it is necessary to reduce the step width ΔG of the gradation levels of the electro-optical elements, in particular within a low-gradation range. In this case, it is also necessary to finely change the voltage of the data signal, and there arises a problem of increasing the cost of the electro-optical device.

SUMMARY

An advantage of some aspects of the invention is that it provides a technique for fine control of the gradation of electro-optical elements while maintaining a certain step width of levels of a data signal.

According to an aspect of the invention, an electro-optical device includes a unit circuit including a first element section that controls a first electro-optical element to a gradation level corresponding to a level of a data signal, and a second element section that controls a second electro-optical element to a gradation level corresponding to a level of a data signal, the gradation level of the first electro-optical element being lower than the gradation level of the second electro-optical element when data signals having an identical level are applied to the first element section and the second element section; and a signal generating circuit that generates data signals having different levels according to a gradation value specified for the unit circuit. When the gradation value is within a first gradation range, the signal generating circuit applies to the first element section a data signal whose level is determined so that the first electro-optical element is controlled to a gradation level corresponding to the gradation value. When the gradation value is within a second gradation range higher than the first gradation range, the signal generating circuit applies to the second element section a data signal whose level is determined so that the second electro-optical element is controlled to a gradation level corresponding to the gradation value.

According to the invention, the gradation level of the first electro-optical element is lower than the gradation level of the second electro-optical element when data signals having an identical level are applied to the first element section and the second element section (that is, the first element section and the second element section have different gradation change rates). With this structure, when a gradation value in the first gradation range is specified, the first electro-optical element is controlled by the data signal corresponding to the gradation value. Therefore, when a gradation value in the first gradation range is specified, the step width of levels of the data signal can be sufficiently maintained compared with a structure in which one electro-optical element having a characteristic equivalent to that of the second electro-optical element is controlled regardless of the gradation value specified for the unit circuit. When a gradation value in the second gradation range is specified, the second electro-optical element is controlled. Therefore, a wide range of multiple gradation levels can be represented while the levels of the data signals are suppressed (that is, the power consumption is reduced) compared with a structure in which one electro-optical element having a characteristic equivalent to that of the first electro-optical element is controlled regardless of the gradation value specified for the unit circuit.

In the invention, each of the electro-optical elements is an element whose optical characteristics, such as brightness and transmittance, vary in accordance with electric energy applied thereto (such as a supplied current or a applied voltage). Each of the electro-optical elements may be a self-emission element that emits light or a non-emission element (such as a liquid crystal element) that variably controls the transmittance of ambient light, or may be a current-driven element that is driven by a supplied current or a voltage-driven element that is driven by an applied voltage. Various electro-optical elements can be used such as an OLED element, an inorganic EL element, a field emission (FE) element, a surface-conduction electron-emitter (SE) element, a ballistic electron surface emitting (BS) element, a light emitting diode (LED) element, a liquid crystal element, an electrophoresis element, and an electrochromic element.

In the invention, each of the data signals may be a current signal or a voltage signal. When the data signal is a current signal, the data signal has a level indicative of a current value. When the data signal is a voltage signal, the data signal has a level indicative of a voltage value. While the unit circuit is formed of the first element section and the second element section, the unit circuit may include three or more element sections including the first element section and the second element section.

It is preferable that the area of a region of the first electro-optical element from which light is output is different from the area of a region of the second electro-optical element from which light is output. Therefore, the first electro-optical element and the second electro-optical element can be manufactured commonly using a process while the first element section and the second element section have different gradation change rates. The structure in which element sections having different gradation change rates are provided can be achieved by the following approaches.

In a first approach, each of the first electro-optical element and the second electro-optical element is a light-emitting element including a first electrode, a second electrode, and a light-emitting layer between the first electrode and the second electrode, wherein a distance between the first electrode and the second electrode of the first electro-optical element is different from a distance between the first electrode and the second electrode of the second electro-optical element. In other words, the thickness of a portion that is provided between the first electrode and the second electrode of the first electro-optical element and that includes the light-emitting layer is different from that of the second electro-optical element.

In a second approach, each of the first electro-optical element and the second electro-optical element is a light-emitting element including a first optically transparent electrode, a second optically reflective electrode facing the first electrode, and a light-emitting layer between the first electrode and the second electrode, and the first electrode of the first electro-optical element and the first electrode of the second electro-optical element have different thicknesses.

In a third approach, the electro-optical device further includes an optically transparent insulation layer defined on a surface of a substrate. Each of the first electro-optical element and the second electro-optical element is a light-emitting element including a first optically transparent electrode defined on a surface of the insulation layer, a second optically reflective electrode facing the first electrode, and a light-emitting layer between the first electrode and the second electrode, wherein the thickness of a region of the insulation layer through which light output from the first electro-optical element is transmitted is different from the thickness of a region of the insulation layer through which light output from the second electro-optical element is transmitted.

In a fourth approach, the electro-optical device further includes a first light-transmitting member through which light output from the first electro-optical element is transmitted, and a second light-transmitting member through which light output from the second electro-optical element is transmitted, wherein the first light-transmitting member and the second light-transmitting member have different transmittances.

In the first to fourth approaches described above, the area of the first electro-optical element and the area of the second electro-optical element can be equal to each other. That is, the area of the second electro-optical element does not need to be larger than the area of the first electro-optical element. Therefore, advantageously, high-definition electro-optical elements can be easily realized.

The structure in which the gradation change rate of the first element section is different from the gradation change rate of the second element section is not limited to those described above. For example, the first element section may include a first driving transistor that generates a drive current corresponding to a voltage at a gate of the first driving transistor and that supplies the drive current to the first electro-optical element, and the second element section may include a second driving transistor that generates a drive current corresponding to a voltage at a gate of the second driving transistor and that supplies the drive current to the second electro-optical element, wherein the drive current generated by the first driving transistor and the drive current generated by the second driving transistor have different current values when the same voltage is applied to the gate of the first driving transistor and the gate of the second driving transistor. Therefore, advantageously, the conditions of the electro-optical elements (such as the area of the electro-optical elements and the thickness of layers) do not need to be different for each of element section.

Further, the characteristics of elements (such as an electro-optical element and a driving transistor) included in each element section do not need to be differently set. For example, the first element section may control the first electro-optical element to emit light at a brightness corresponding to the level of the data signal in a first period, and the second element section may control the second electro-optical element to emit light at a brightness corresponding to the level of the data signal in a second period longer than the first period. With this structure, the gradation change rates can be different for each of the first element section and the second element section according to the time length of the first period and the second period. A specific example of this structure is described below with respect to a third embodiment of the invention.

It is preferable that the first element section controls the first electro-optical element to a gradation level corresponding to a voltage value of the data signal; the second element section controls the second electro-optical element to a gradation level corresponding to a current value of the data signal; and the signal generating circuit includes a voltage generating circuit that outputs a data signal having a voltage value corresponding to the gradation value specified for the unit circuit to the first element section when the gradation value is within the first gradation range, and a current generating circuit that supplies a data signal having a current value corresponding to the gradation value to the second element section when the gradation value is within the second gradation range. With this structure, the first electro-optical element is driven according to the voltage value of the data signal when the gradation value is within the second nigh-gradation range, and the second electro-optical element is driven according to the current value of the data signal when the gradation value is within the first low-gradation range. Therefore, even if a transmission channel of the data signal has a high time constant, the first electro-optical element can be reliably set to a predetermined gradation level. A specific example of this structure is described below with respect to a fourth embodiment of the invention.

The electro-optical device according to the invention can be used in various electronic apparatuses. The electronic apparatuses are typically apparatuses using the electro-optical device as a display device. Examples of the electronic apparatuses include personal computers and mobile phones. However, the use of the electro-optical device according to the invention is not limited to the display of images. The electro-optical device according to the invention can be used in various applications such as an exposure apparatus (namely, an exposure head) for irradiating an image bearing member such as a photoconductive drum with light to form a latent image on the image bearing member, an apparatus (such as a backlight) disposed on a back surface of a light crystal device for lighting the light crystal device, and various lighting apparatuses such as apparatuses included in an image reading apparatus such as a scanner for irradiating a document with light.

According to another aspect, the invention provides a method for driving the electro-optical device. The method includes determining which of a plurality of gradation ranges including a first gradation range and a second gradation range higher than the first gradation range a gradation value specified for the unit circuit belongs to; and generating data signals having different levels according to the gradation value, wherein when it is determined that the gradation value is within the first gradation range, a data signal whose level is determined so that the first electro-optical element is controlled to a gradation level corresponding to the gradation value is applied to the first element section, and when it is determined that the gradation value is within the second gradation range, a data signal whose level is determined so that the second electro-optical element is controlled to a gradation level corresponding to the gradation value is applied to the second element section. The above-described method can also achieve similar advantages to those of the electro-optical device according to the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
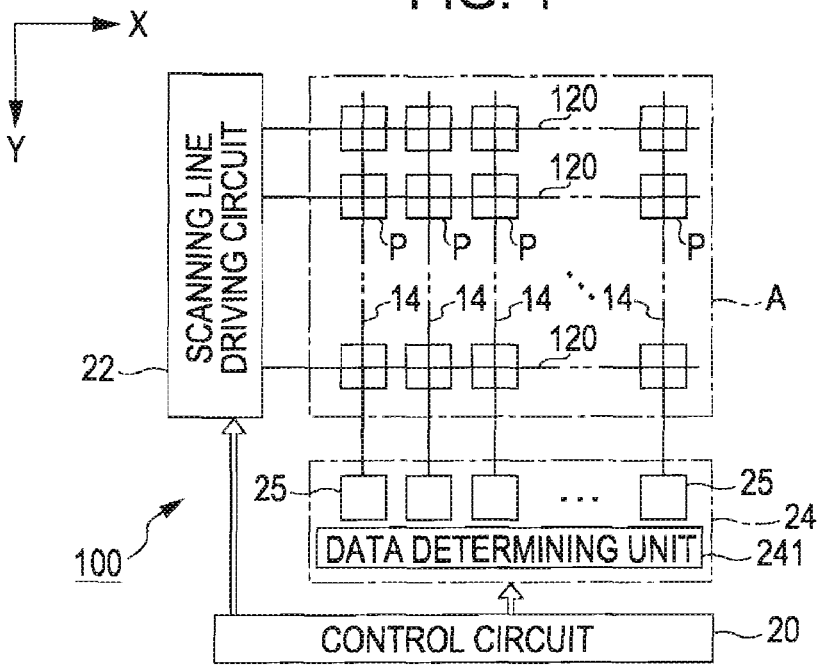
FIG. 1 is a block diagram showing the structure of an electro-optical device according to the invention.

FIG. 1 is a block diagram showing the structure of an electro-optical device 100 according to a first embodiment of the invention. As shown in FIG. 1, the electro-optical device 100 includes an element array section A having a large number of unit circuits P, a scanning line driving circuit 22 and data line driving circuit 24 that drive each of the unit circuits P, and a control circuit 20 that controls the scanning line driving circuit 22 and the data line driving circuit 24. The large number of unit circuits P are arranged in a matrix of m rows and n columns in X- and Y-axes orthogonal to each other (where each of m and n is a natural number of 2 or more).

Figure 2:
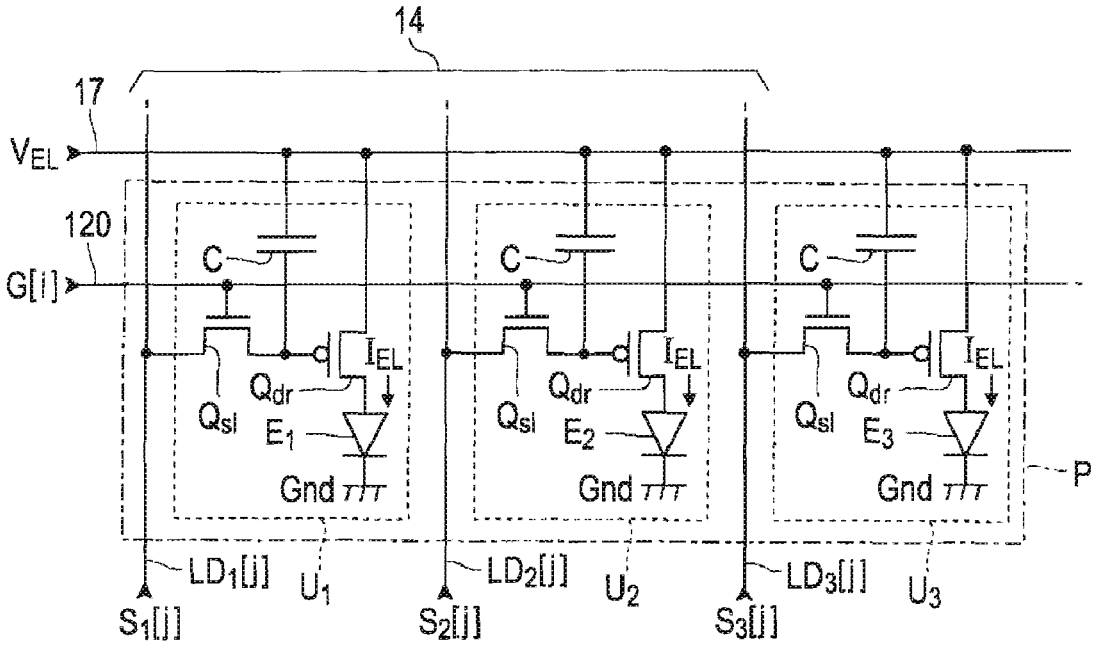
FIG. 2 is a circuit diagram showing the structure of each unit circuit.

FIG. 2 is a circuit diagram showing the structure of each of the unit circuits P. In FIG. 2, one of the unit circuits P that is positioned at the j-th column (where j is an integer satisfying $1 \leqq j \leqq n$) in the i-th row (where i is an integer satisfying $1 \leqq i \leqq m$) is illustrated. All the unit circuits P have a similar structure. As shown in FIGS. 1 and 2, the element array section A includes m scanning lines 120 extending along the X-axis, and n line groups 14 extending along the Y-axis. Each of the unit circuits P is located at a position corresponding to an intersection of each of the scanning lines 120 and each of the line groups 14. As shown in FIG. 2, the line group 14 at the j-th column includes three data lines LD1[j] to LD3[j] each extending along the Y-axis. A power supply potential $V_{EL}$ is supplied to each of the unit circuits P via a power supply-line 17.

Figure 3:
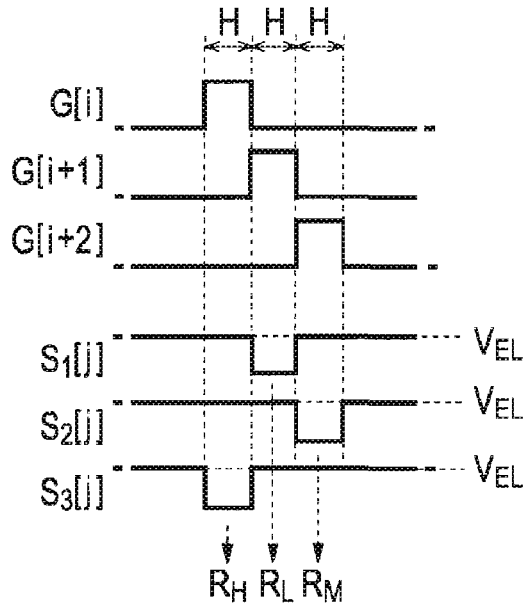
FIG. 3 is a timing chart showing the operation of the electro-optical device.

The scanning line driving circuit 22 shown in FIG. 1 is a circuit (e.g., an m-bit shift register) operable to generate scanning signals G[1] to G[m] for sequentially selecting the m rows of the element array section A (i.e., the scanning lines 120) and to output the scanning signals G[1] to G[m] to the scanning lines 120. As shown in FIG. 3, the control signal G[i] output to the i-th scanning line 120 is at a high (selection) level for the i-th horizontal scanning period H within a period of one frame, and is maintained at a low (non-selection) level for the remaining period.

The control circuit 20 controls the timing of the operation of the scanning line driving circuit 22 and the data line driving circuit 24 according to an output of various signals such as a clock signal. Further, the control circuit 20 sequentially outputs image data for specifying a gradation value D of each of the unit circuits P to the data line driving circuit 24. As shown in FIG. 1, the data line driving circuit 24 includes a data determining unit 241 that determines a range R to which the gradation value D of each of the unit circuits P belongs, and n signal generating circuits 25, where n denotes the total number of line groups 14 (i.e., the number of columns of the unit circuits P). The data determining unit 241 determines which of three ranges R (namely, $R_L$, $R_M$, and $R_H$) the gradation value D supplied from the control circuit 20 belongs to. The range of the gradation value D from the minimum value to the maximum value is divided into the ranges $R_L$, $R_M$, and $R_H$ that do not overlap. The range $R_L$ includes the minimum value of the gradation value D, and the range $R_H$ includes the maximum value of the gradation value D. The range $R_M$ is a gradation range higher than the range $R_L$, and the range $R_H$ is a gradation range higher than the range $R_M$.

The signal generating circuit 25 at the j-th column generates data signals S1[j] to S3[j], and outputs the data signals S1[j] to S3[j] to the line group 14 at the j-th column. Each of the data signals S1[j] to S3[j] is a voltage signal whose voltage value $V_d$ is designated according to the gradation value D of the j-th column and a determination result of the data determining unit 241. The data signal Sk[j] (where k is an integer satisfying $1 \leqq k \leqq 3$) is output to the data line LDk[j]. The operation of the signal generating circuits 25 is described in detail below.

The structure of the unit circuits P will be described in detail. As shown in FIG. 2, each of the unit circuits P includes three element sections U1 to U3, the number of element sections corresponding to the number of sections the range R is divided. The element section Uk includes an electro-optical element Ek arranged on a path extending from the power supply line 17 to a ground line (a ground potential Gnd). In the first embodiment, the electro-optical element Ek is an OLED element having a light-emitting layer formed of an organic electroluminescent (EL) material between electrodes facing each other. The light-emitting layer emits light when a current (hereinafter referred to as a "drive current") $I_{EL}$ is supplied.

The element section Uk further includes a p-channel driving transistor Qdr on the path of the drive current $I_{EL}$ (between the power supply line 17 and the electro-optical element Ek). The driving transistor Qdr is a thin-film transistor that generates the drive current $I_{EL}$ having a current amount corresponding to the voltage at a gate of the driving transistor Qdr and that supplies the drive current $I_{EL}$ to the electro-optical element Ek. The element section Uk further includes a selection transistor Qsl between the gate of the driving transistor Qdr and the data line LDk[j] for controlling the electrical connection (conduct ion/non-conduction) therebetween. The gates of the selection transistors Qsl included in the element sections U1 to U3 of each of the unit circuits P in the i-th row are commonly connected with the scanning line 120 in the i-th row. A capacitor element C is provided between the gate and source (on the side of the power supply line 17) of the driving transistor Qdr.

When the scanning signal G[i] changes to a high level in a horizontal scanning period H, the selection transistors Qsl included in the element sections U1 to U3 of each of the unit circuits P in the i-th row are turned on at the same time. Therefore, the gate of the driving transistor Qdr of the element section Uk is set to the voltage value $V_d$ of the data signal Sk[j] supplied to the data line LDk[j] in that horizontal scanning period H. During this period, electric charge corresponding to the voltage value $V_d$ is accumulated in the capacitor element C. Thus, even if the scanning signal G[i] changes to a low level and the selection transistors Qsl are turned off, the gates of the driving transistors Qdr are maintained at the voltage value $V_d$. The drive current $I_{EL}$ corresponding to the voltage value $V_d$ is continuously supplied to the electro-optical element Ek until the next time the scanning signal G[i] changes to the high level. Accordingly, the electro-optical element Ek is set to the gradation level (i.e., the amount of light emission) corresponding to the voltage value $V_d$ of the data signal Sk[j].

Figure 4:
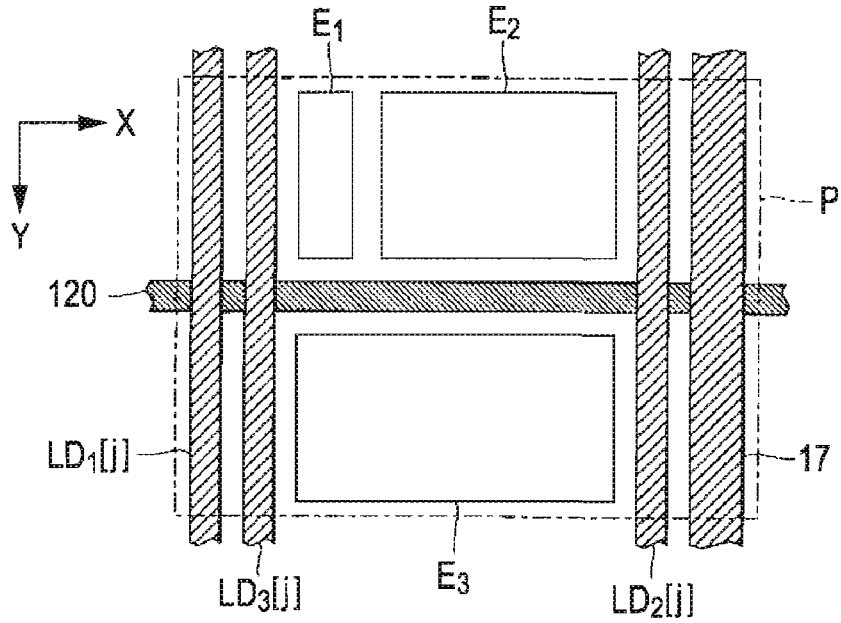
FIG. 4 is a plan view showing the arrangement of electro-optical elements and lines.

FIG. 4 is a plan view of each of the unit circuits P, showing the arrangement of the electro-optical elements E1 to E3 and the lines. As shown in FIG. 4, the areas of the electro-optical elements E1 to E3 are different from each other. Specifically, the area of the electro-optical element E2 is larger than that of the electro-optical element E1, and the area of the electro-optical element E3 is larger than that of the electro-optical element E2. The electro-optical elements E1 and E2 are arranged along the X-axis and are disposed in the negative direction of the Y-axis with respect to the scanning line 120. The electro-optical element E3 is arranged in the positive direction of the Y-axis with respect to the scanning line 120. The data lines LD1[j] and LD3[j] extend along the Y-axis and are disposed in the negative direction of the X-axis as viewed from the electro-optical elements E1 to E3. The data line LD2[j] and the power supply line 17 extend along the Y-axis and are disposed in the positive direction of the X-axis as viewed from the electro-optical elements E1 to E3.

Figure 5:
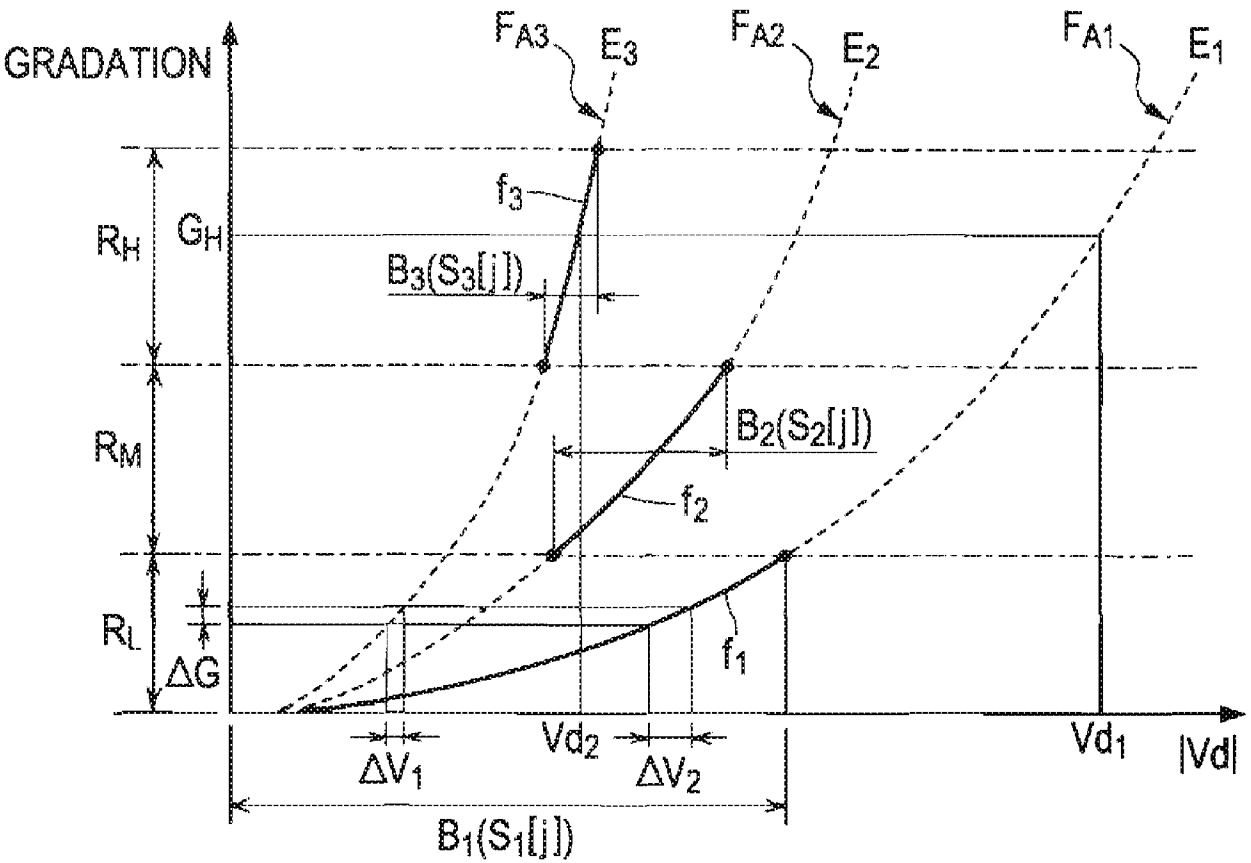
FIG. 5 is a graph showing the relationship between voltage values of a data signal and the gradation (amount of light emission) of each of the electro-optical elements.

FIG. 5 is a graph showing the relationship between the voltage value $V_d$ of the data signal Sk[j] and the gradation of the electro-optical element Ek. In FIG. 5, a characteristic curve $F_{Ak}$ indicates the relationship between the absolute value of the voltage value $V_d$ of the data signal Sk[j] and the actual gradation level (i.e., the amount of light emission) of the electro-optical element Ek. In the first embodiment, as shown in FIG. 4, the areas of the electro-optical elements E1 to E3 are different from each other. Thus, even if the data signals S1[j] to S3[j] having the same voltage value $V_d$ are supplied to the element sections U1 to U3, as shown in FIG. 5, the gradation levels (i.e., amounts of light emission) of the electro-optical elements E1 to E3 are different from each other. Specifically, when the data signals S1[j] to S3[j] having the same voltage value $V_d$ are supplied, the gradation level of the electro-optical element E1 is lower than that of the electro-optical element E2, and the gradation level of the electro-optical element E3 is higher than that of the electro-optical element E2. In other words, relative ratios of the change amounts of the gradation levels of the electro-optical elements E1 to E3 with respect to the change amounts of the voltage values $V_d$ of the data signals S1[j] to S3[j] (the relative ratio is hereinafter referred to as a "gradation change rate") are as follows: the gradation change rate for the electro-optical element E3 is maximum, and the gradation change rate for the electro-optical element E1 is minimum. The gradation change rate is defined by "(the change amount of the gradation)/(the change amount of the voltage value $V_d$)", and is a numerical value used as an index of sensitivity, which measures a change in the gradation level of the electro-optical element Ek in accordance with the voltage value $V_d$ (that is, if the gradation change rate is higher, the gradation level of the electro-optical element Ek varies more sensitively to a change of the voltage value $V_d$).

The signal generating circuit 25 at the j-th column determines the voltage values $V_d$ of the data signals S1[j] to S3[j] so that one electro-optical element Ek corresponding to the range R to which the gradation value D belongs can be selectively driven to the gradation level corresponding to the gradation value D from among the electro-optical elements E1 to E3 of the unit circuits P at the j-th column.

For example, when the data determining unit 241 determines that the gradation value D is within the range $R_L$, the signal generating circuit 25 generates the data signal S1[j] having a voltage value $V_d$ within a range B1 shown in FIG. 5 in accordance with the gradation value D, and sets the data signals S2[j] and S3[j] to a voltage value $V_d$ for turning off the corresponding electro-optical elements E2 and E3 (i.e., the power supply potential $V_{EL}$). When the gradation value D is within the range $R_M$, the signal generating circuit 25 generates the data signal S2[j] having a voltage value $V_d$ within a range B2 shown in FIG. 5 in accordance with the gradation value D, and generates the data signals S1[j] and S3[j] having a voltage value $V_d$ for turning off the electro-optical elements E1 and E3. When the gradation value D is within the range $R_H$, the signal generating circuit 25 generates the data signal S3[j] having a voltage value $V_d$ within a range B3 shown in FIG. 5 in accordance with the gradation value D, and generates the data signals S1[j] and S2[j] having a voltage value $V_d$ for turning off the electro-optical elements E1 and E2.

For example, a gradation value D within the range $R_H$ is designated for the unit circuit P at the j-th column in the i-th row, a gradation value D within the range $R_L$ is designated for the unit circuit P at the j-th column in the (i+1)-th row, and a gradation value D within the range $R_M$ is designated for the unit circuit P at the j-th column in the (i+2)-th row. In this case, as shown in FIG. 3, in the horizontal scanning period H during which the scanning signal G[i] is at the high level, the data signal S3[j] is set to the voltage value $V_d$ (which has a potential lower than the power supply potential $V_{EL}$) for turning on the electro-optical element E3 at the gradation level corresponding to the gradation value D, and the data signals S1[j] and S2[j] are set to the voltage value $V_d$ (equal to the power supply potential $V_{EL}$) for turning off the electro-optical elements E1 and E2. In the horizontal scanning period H during which the scanning signal G[i+1] is at the high level, the data signal S1[j] is set to the voltage value $V_d$ corresponding to the gradation value D, and the data signals S2[j] and S3[j] are set to the power supply potential $V_{EL}$. In the horizontal scanning period H during which the scanning signal G[i+2] is at the high level, the data signal S2[j] is set to the voltage value $V_d$ corresponding to the gradation value D, and the data signals S1[j] and S3[j] are set to the power supply potential $V_{EL}$.

Accordingly, the voltage value $V_d$ of one data signal Sk[j] selected from among the data signals S1[j] to S3[j] according to the range R of the gradation value D is determined according to the gradation value D. Therefore, in FIG. 5, a curve portion fk indicated by a solid line from among the characteristic curve $F_{Ak}$ of the electro-optical element Ek is used. That is, light is output (or displayed) at a gradation level within the range $R_L$ by light emission of the electro-optical element E1 (indicated by the curve portion f1), at a gradation level within the range $R_M$ by light emission of the electro-optical element E2 (indicated by the curve portion f2), and at a gradation level within the range $R_H$ by light emission of the electro-optical element E3 (indicated by the curve portion f3).

In the first embodiment, therefore, the electro-optical element E1 having the minimum gradation change rate is driven when a gradation value D within the low-gradation range $R_L$ is designated, and the electro-optical element E3 having the maximum gradation change rate is driven when a gradation value D within the high-gradation range $R_H$ is designated. Therefore, advantageously, the voltage values $V_d$ of the data signals S1[j] to S3[j] can be reduced while the step width of the voltage values $V_d$ of the data signals S1[j] to S3[j] is sufficiently maintained. This advantage will be described in detail.

A structure in which each of the unit circuits P includes only the element section U3 (that is, a structure in which all the gradation values D are represented by the electro-optical element E3 having a high gradation change rate) is given as a first comparative example. With the structure of the first comparative example, as shown in FIG. 5, it is necessary to change the voltage value $V_d$ of the data signal S3[j] by a fine change amount ΔV1 in order to change the gradation level of the electro-optical element E3 by a value ΔG within the range $R_L$. In this case, the data line driving circuit 24 that is expensive to allow for fine adjustment of the voltage value $V_d$ is required. In the first embodiment, on the other hand, since a gradation value D within the range $R_L$ is represented by the electro-optical element E1 having a low gradation change rate, a change amount ΔV2 of the voltage value $V_d$ required for changing the gradation value D by the value ΔG is larger than the change amount ΔV1 in the first comparative example. In the first embodiment, therefore, the need for fine adjustment of the change amount of the voltage value $V_d$ of the data signal Sk[j] can be eliminated or reduced, and the data line driving circuit 24 can be less expensive than that in the first comparative example.

A structure in which each of the unit circuits P includes only the element section U1 (that is, a structure in which all the gradation values D are represented by the electro-optical element E1 having a low gradation change rate) is given as a second comparative example. With the structure of the second comparative example, as shown in FIG. 5, it is necessary to increase the data signal S1[j] to a voltage value $V_{d1}$ in order to control the electro-optical element E1 to a gradation level GH within the range $R_H$, resulting in a problem of excessive power consumption in the data line driving circuit 24. In the first embodiment, on the other hand, gradation values D within the ranges $R_M$ and $R_H$ are represented by the electro-optical elements E2 and E3 having a higher gradation change rate than the electro-optical element E1. Thus, for example, a voltage value $V_d$ of the data signal S3[j] required to control the electro-optical element E3 to the gradation level GH is equal to a voltage value $V_{d2}$ that is greatly lower than the voltage value $V_{d1}$ in the second comparative example. According to the first embodiment, since the voltage value $V_d$ required for nigh-gradation output is reduced, advantageously, the data line driving circuit 24 can achieve lower power consumption than the second comparative example.

Second Embodiment

In the first embodiment, the electro-optical elements E1 to E3 have different gradation change rates according to the areas of the electro-optical elements E1 to E3. A specific method for selecting a gradation change rate for each electro-optical element Ek can be modified in various ways as below. The following description will be given while focusing on the electro-optical elements E1 and E2. A similar structure can be used to adjust the gradation change rate of the electro-optical element E3 to a predetermined value. In the following description, the electro-optical elements E1 to E3 are referred to simply as "electro-optical elements E" unless they are separately identified. In the figures described in conjunction with the following methods, elements having the same or similar advantages and functions are represented by the same reference numerals.

First Method

Figure 6:
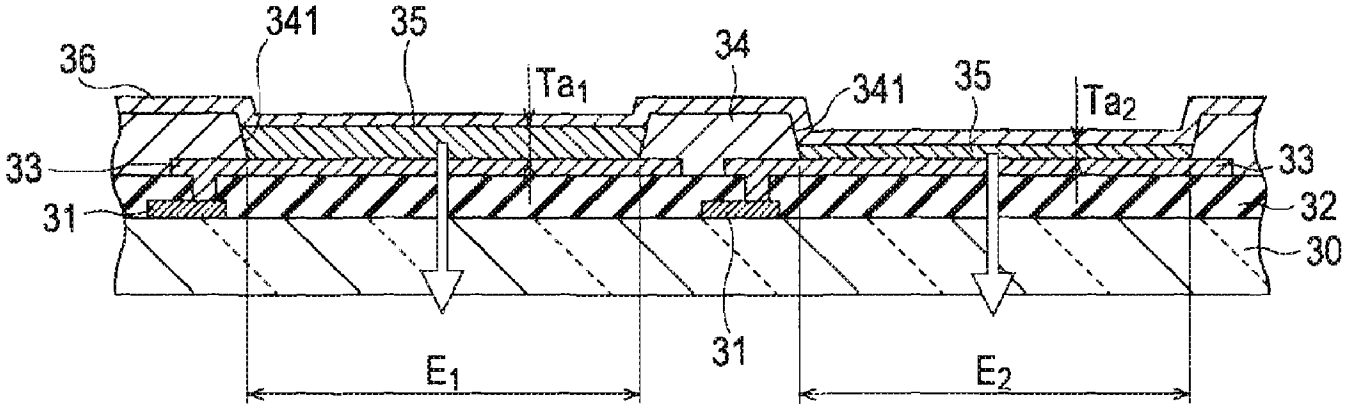
FIG. 6 is a cross-sectional view showing the structure of an element array section according to a first method in a second embodiment of the invention.

FIG. 6 is a cross-sectional view of an element array section A according to a first method in a second embodiment of the invention. As shown in FIG. 6, lines 31 electrically connected with the drains of the driving transistors Qdr are defined on a surface of an optically transparent substrate 30. The surface of the substrate 30 having elements such as the driving transistors Qdr and the lines 31 defined thereon is overlaid by an insulation layer 32. On a surface of the insulation layer 32, first electrodes 33 serving as anodes of the electro-optical elements E are arranged apart from each other to define the electro-optical elements E.

The first electrodes 33 are formed of an optically-transparent conductive material such as indium tin oxide (ITO), and are electrically connected to the lines 31 (and then the driving transistors Qdr) via contact holes in the insulation layer 32. On the surface of the insulation layer 32 having the first electrodes 33 defined thereon, a partition layer 34 is defined.

The partition layer 34 is an insulating film having openings 341 in regions where the partition layer 34 and the first electrodes 33 overlap.

In recesses surrounded by the inner periphery of the openings 341 in the partition layer 34, of which the bottom surfaces correspond to surfaces of the first electrodes 33, light-emitting function layers 35 are defined. The light-emitting function layers 35 include a light-emitting layer formed of an organic EL material. Each of the light-emitting function layers 35 may be formed of a laminate of various function layers (such as a hole injection layer, a hole transporting layer, an electron injection layer, an electron transporting layer, a hole block layer, and an electron block layer) for facilitating or efficiently performing light emission of the light-emitting layer. A second electrode 36 serving as cathodes of the electro-optical elements E is defined on a surface of the partition layer 34 and the light-emitting function layers 35. The second electrode 36 is a continuous conductive layer defined over the plurality of electro-optical elements E. The second electrode 36 has light reflectivity. Therefore, as indicated by arrows shown in FIG. 6, a light beam output from the light-emitting function layers 35 to the substrate 30 and a light beam reflected from a surface of the second electrode 36 are transmitted through the insulation layer 32 and the substrate 30, and are emitted outside the electro-optical device 100.

In the first embodiment, the gradation change rates of the electro-optical elements E1 to E3 are different from each other according to the areas of the light-emitting function layers 35 (that is, the areas of the regions where a current flows between the first electrodes 33 and the second electrode 36). In the first method of the second embodiment, on the other hand, the areas of the light-emitting function layers 35 of the electro-optical elements E are substantially equal to each other, whereas the thickness of the light-emitting function layers 35 (in other words, the distance between the first electrodes 33 and the second electrode 36) is adjusted for each of the electro-optical elements E to obtain different gradation change rates of the electro-optical elements E. As shown in FIG. 6, a thickness Ta1 of the light-emitting function layer 35 of the electro-optical element E1 is larger than a thickness Ta2 of the light-emitting function layer 35 of the electro-optical element E2. The smaller the thickness of the light-emitting function layer 35, the larger the amount of light emission when a predetermined voltage is applied between the first electrodes 33 and the second electrode 36. In the structure shown in FIG. 6, therefore, as in the first embodiment, the gradation change rate of the electro-optical element E1 is lower than that of the electro-optical element E2.

Second Method

Figure 7:
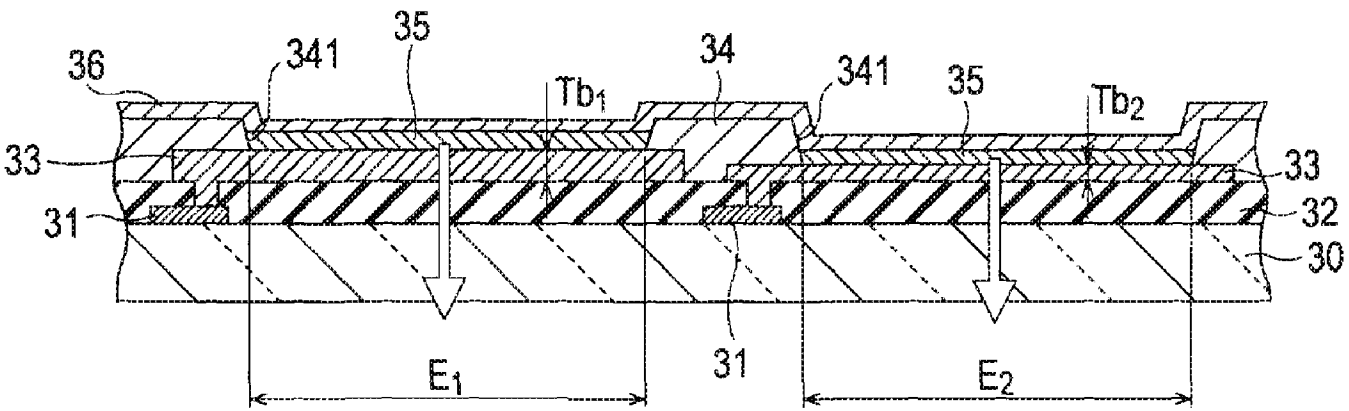
FIG. 7 is a cross-sectional view snowing the structure of an element array section according to a second method in the second embodiment.

FIG. 7 is a cross-sectional view of an element array section A according to a second method in the second embodiment. As shown in FIG. 7, elements forming the electro-optical elements E and the lamination order of the elements are similar to those shown in FIG. 6. In the second method, however, the first electrodes 33 of the electro-optical elements E have different thicknesses. For example, as shown in FIG. 7, a thickness Tb1 of the first electrode 33 of the electro-optical element E1 is larger than a thickness Tb2 of the first electrode 33 of the electro-optical element E2.

In the structure shown in FIG. 7, the insulation layer 32 is formed of a material having a different refractive index from the substrate 30. Thus, the interface between the insulation layer 32 and the substrate 30 serves as a transflective surface that allows a portion of light incident to the interface to pass to the substrate 30 and another portion to be reflected in the direction opposite to the substrate 30. Therefore, a resonator structure in which light beams output from the light-emitting function layers 35 resonate between the transflective surface and the surface of the second electrode 36 is obtained. That is, the light beams output from the light-emitting function layers 35 reciprocate between the transflective surface and the surface of the second electrode 36, and a component in a frequency band (or resonant wavelength) corresponding to the distance between both interfaces is selectively transmitted through the substrate 30 and is emitted.

Figure 8:
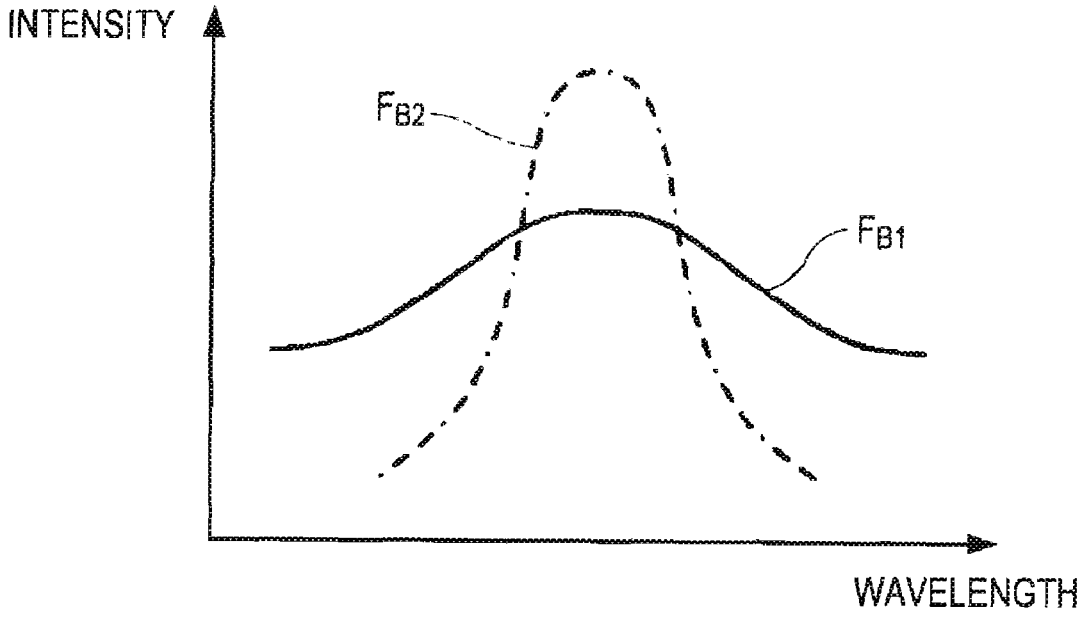
FIG. 8 is a graph showing the spectral characteristic of light beams output from electro-optical elements.

In the second method of the second embodiment, the thickness of the first electrodes 33 forming the resonator structure (i.e., the optical path length of light output from the light-emitting function layers 35 until it is transmitted through the transflective surface) is different from one electro-optical element E to another. Hence, the spectral characteristic of light output from the light-emitting function layers 35 and transmitted through the substrate 30 when a predetermined voltage is applied between the first electrodes 33 and the second electrode 36 is different between the electro-optical elements E1 and E2. For example, as shown in FIG. 8, the light output from the electro-optical element E1 exhibits a characteristic curve $F_{B1}$ in which the intensity is distributed uniformly over a wide range, while the light output from the electro-optical element E2 exhibits a characteristic curve $F_{B2}$ in which the intensity is high within a narrow range including the resonant wavelength. With this structure, as in the first embodiment, the gradation change rate of the electro-optical element E1 can be set lower than that of the electro-optical element E2.

Third Method

Figure 9:
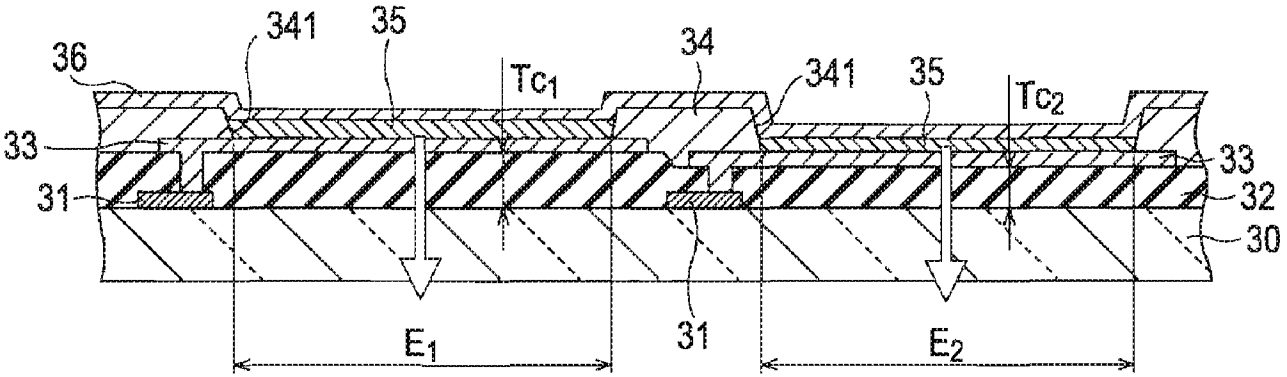
FIG. 9 is a cross-sectional view showing the structure of an element array section according to a third method in the second embodiment.

FIG. 9 is a cross-sectional view of an element array section A according to a third method in the second embodiment. As shown in FIG. 9, in the third method, the insulation layer 32 has different thicknesses for the electro-optical elements E. For example, as shown in FIG. 9, a thickness Tc1 of a portion of the insulation layer 32 corresponding to the electro-optical element E1 is larger than a thickness Tc2 of a portion of the insulation layer 32 corresponding to the electro-optical element E2. Also in the structure shown in FIG. 9, the optical path length of light output from the light-emitting function layers 35 until it is transmitted through the transflective surface is different from one electro-optical element E to another. Hence, the spectral characteristic of the light transmitted through the substrate 30 is different between the electro-optical elements E1 and E2 in the manner shown in FIG. 8. The gradation change rate of the electro-optical element E1 can therefore be set lower than that of the electro-optical element E2.

Fourth Method

Figure 10:
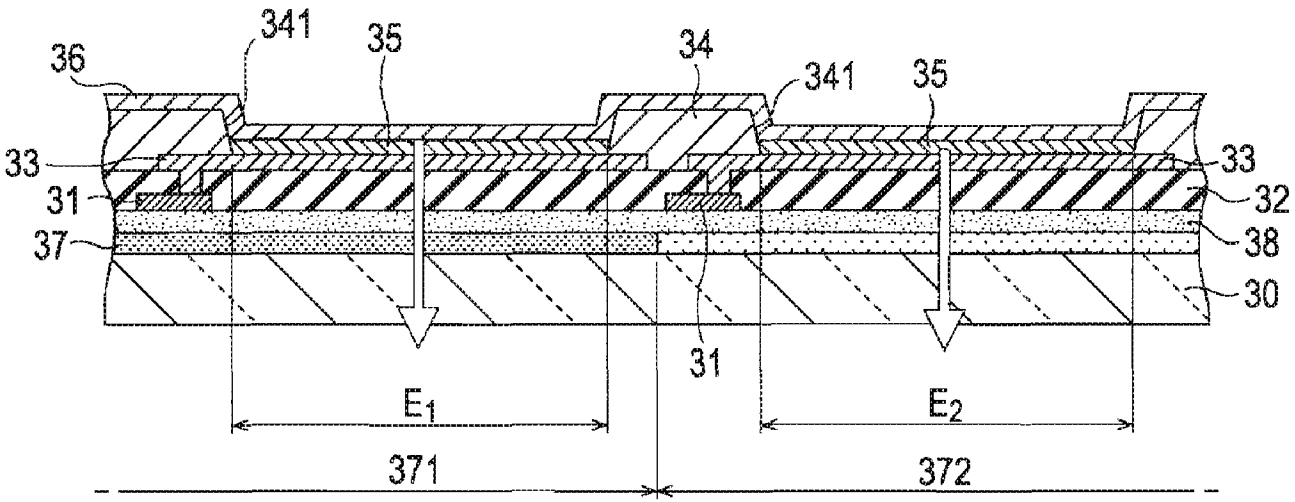
FIG. 10 is a cross-sectional view showing the structure of an element array section according to a fourth method in the second embodiment.

FIG. 10 is a cross-sectional view of an element array section A according to a fourth method in the second embodiment. As shown in FIG. 10, according to the fourth method, the electro-optical device 100 further includes a neutral density (ND) filter 37 bonded to the surface of the substrate 30 in addition to the elements shown in FIG. 6. The insulation layer 32 is adhered to a surface of the ND filter 37 using an optical transparent adhesive 38. The light beams output from the electro-optical elements E are transmitted through the ND filter 37 and the substrate 30, and are emitted to the outside.

Portions of the ND filter 37 that overlap the electro-optical elements E1 to E3 have different transmittances. For example, in the ND filter 37, as shown in FIG. 10, the transmittance of a portion 371 overlapping the electro-optical element E1 is lower than the transmittance of a portion 372 overlapping the electro-optical element E2. Therefore, as in the first embodiment, the gradation change rate of the electro-optical element E1 is lower than that of the electro-optical element E2.

According to the second embodiment, therefore, the gradation change rates of the electro-optical elements E can be individually set with the areas of the electro-optical elements E being equal to each other. Therefore, the space required to install the unit circuits P can be reduced compared with the first embodiment in which the area of the electro-optical element E3 is relatively large. Therefore, advantageously, a high-definition image can be easily achieved.

The structure according to the first to third methods of the second embodiment in which the elements on the substrate 30 have different thicknesses for the electro-optical elements E is manufactured by a method such as by using a different number of laminated layers of the elements depending on each of the electro-optical elements E or by forming the elements so as to have predetermined thicknesses using processes different for the electro-optical elements E. For example, in FIG. 7, the first electrode 33 of the electro-optical element E1 is manufactured by laminating a larger number of conductive layers than the first electrode 33 of the electro-optical element E2. In the manufacturing of the element array section A according to the first to third methods, therefore, the step of forming an element defining the gradation change rate is changed depending on the electro-optical elements E. In the first embodiment, however, since the gradation change rates of the electro-optical elements E are individually determined according to the area of the electro-optical elements E, a method is commonly used to manufacture the elements of each of the electro-optical elements E, thus achieving the advantage of a simplified manufacturing process of the element array section A.

Third Embodiment

A third, embodiment of the invention will be described. In the first embodiment, the electro-optical elements E1 to E3 have different gradation change rates according to the characteristics of the electro-optical elements E1 to E3. In the third embodiment, the gradation change rates are differently set according to the time length during which each of the electro-optical elements E actually emits light. In the third embodiment, elements having the same or similar advantages and functions to those of the first embodiment are represented by the same reference numerals, and a detailed description thereof is appropriately omitted.

Figure 11:
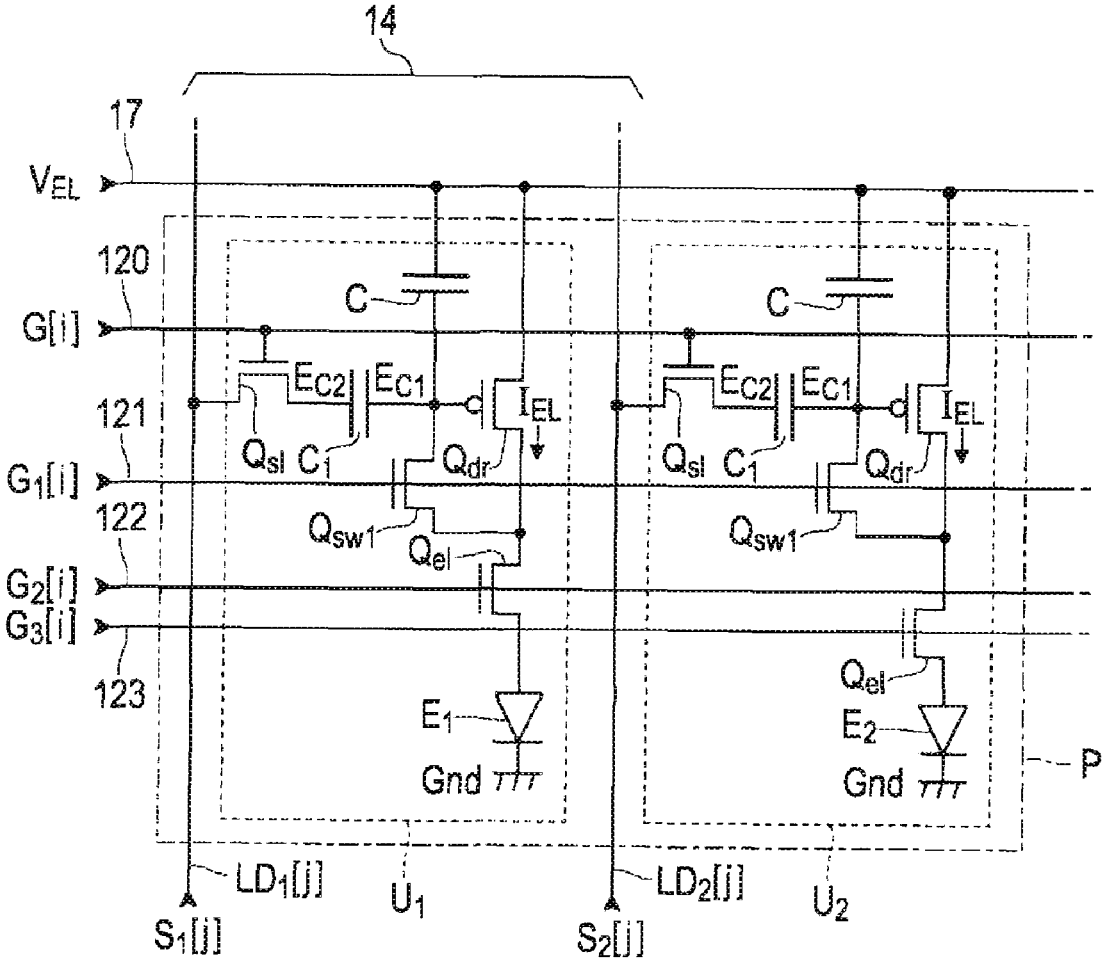
FIG. 11 is a circuit diagram showing the structure of a unit circuit according to a third embodiment of the invention.

FIG. 11 is a circuit diagram showing the structure of the unit circuit P at the j-th column in the i-th row. As shown in FIG. 11, an element array section A of the third embodiment includes a scanning line 120 and three control lines 121 to 123 extending in parallel to the scanning line 120. The scanning line driving circuit 22 outputs a scanning signal G[i] to the scanning line 120, and outputs control signals G1[i], G2[i], and G3[i] to the control lines 121, 122, and 123, respectively. Specific waveforms of those signals are described below.

As shown in FIG. 11, each of the unit circuits P includes two element sections U1 and U2. The element section Uk (where k is 1 or 2 in the third embodiment) includes an electro-optical element Ek. The areas of the electro-optical elements E1 and E2 are equal to each other, and the thicknesses of the layers of the electro-optical elements E1 and E2 are equal to each other. In the third embodiment, the range of the gradation value D from the minimum value to the maximum value is divided into a low-gradation range $R_L$ and a high-gradation range $R_H$. The electro-optical element E1 is driven when the gradation value D is within the range $R_L$, and the electro-optical element E2 is driven when the gradation value D is within the range $R_H$.

The element section Uk includes an n-channel transistor (hereinafter referred to as a "light-emission control transistor") Qel between the drain of the driving transistor Qdr and the anode of the electro-optical element Ek for controlling the electrical connection therebetween. The control signal G2[i] is supplied to a gate of the light-emission control transistor Qel of the element section U1 from the control line 122. The control signal G3[i] is supplied to the gate of the light-emission control transistor Qel of the element section U2 from the control line 123.

The element section Uk further includes an n-channel transistor Qsw1 between the gate and drain of the driving transistor Qdr for controlling the electrical connection therebetween. The control signal G1[i] is commonly supplied to the gates of the transistors Qsw1 in the element sections U1 and U2 from the control line 121.

The element section Uk further includes a capacitor element C1 (with a capacitance value c1) having electrodes Ec1 and Ec2 facing each other with a dielectric member therebetween. The electrode Ec1 is connected with the gate of the driving transistor Qdr. The selection transistor Qsl of the element section Uk is provided between the electrode Ec2 and the data line LDk[j] to control the electrical connection therebetween. As in the first embodiment, a capacitor element C (with a capacitance value c) is provided between the gate and source (on the side of the power supply line 17) of the driving transistor Qdr.

Figure 12:
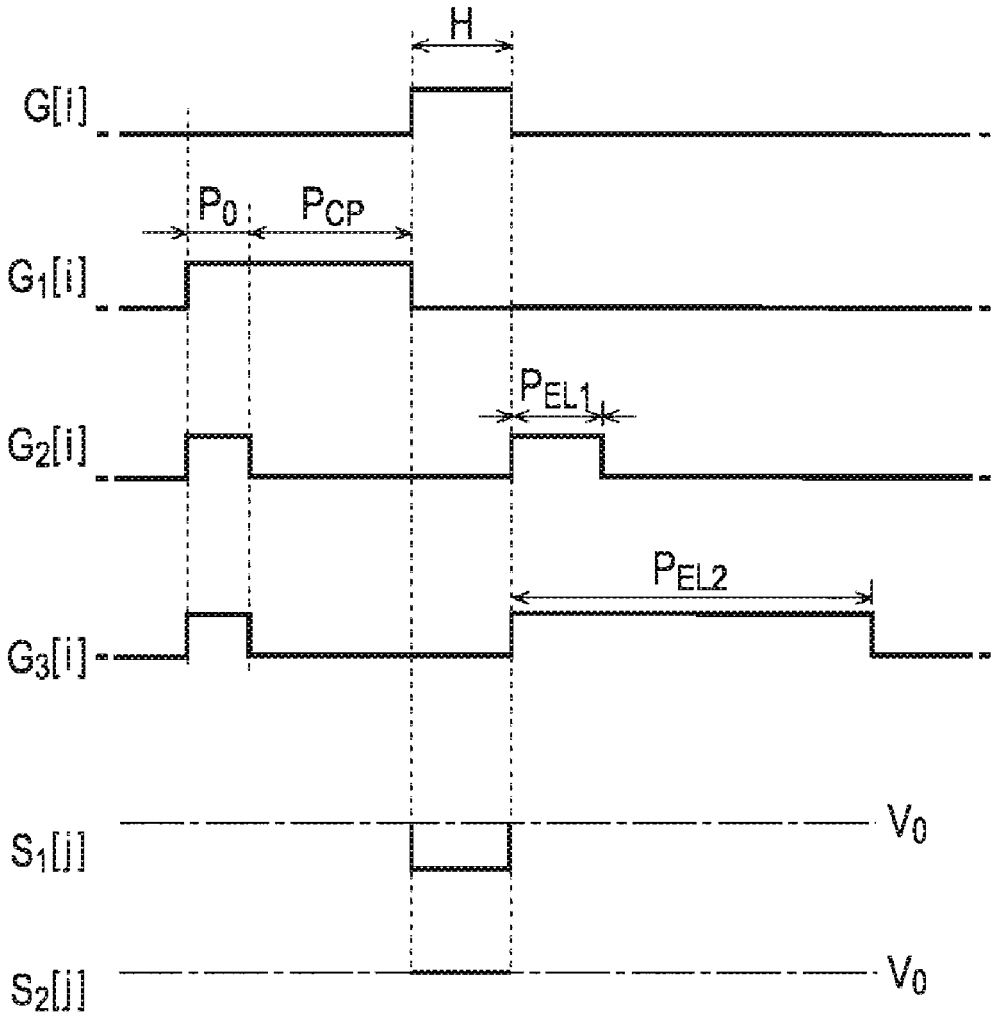
FIG. 12 is a timing chart showing the operation of the electro-optical device.

FIG. 12 is a timing chart showing specific waveforms of the respective signals. As shown in FIG. 12, an initial setting period $P_0$ and a compensation period $P_{CP}$ are designated before the beginning of each horizontal scanning period H. The control signal G1[i] is set to a nigh level in the initial setting period $P_0$ and the compensation period $P_{CP}$ immediately before the horizontal scanning period H during which the scanning signal G[i] is at a high level, and is maintained at a low level in the remaining period. The control signal G2[i] is set to a high level in the initial setting period $P_0$ immediately before the horizontal scanning period H and in a light-emission period $P_{EL1}$ after the lapse of the horizontal scanning period H, and is maintained at a low level in the remaining period. The control signal G3[i] is set to a high level in the initial setting period $P_0$ immediately before the horizontal scanning period H and in a light-emission period $P_{EL2}$ after the lapse of the horizontal scanning period H, and is maintained at a low level in the remaining period. As shown in FIG. 12, the light-emission period $P_{EL2}$ is longer than the light-emission period $P_{EL1}$.

The operation of one of the unit circuits P will be described. First, in the initial setting period $P_0$, the control signals G2[i] and G3[i] change to the high level to thereby turn on the light-emission control transistors Qel of the element sections U1 and U2. Since the control signal G1[i] also changes to the high level, the transistors Qsw1 of the element sections U1 and U2 are turned on. Thereby, the driving transistors Qdr of the element sections U1 and U2 are diode-connected, and the gates of the driving transistors Qdr are initialized to voltages corresponding to the characteristics of the electro-optical elements E1 and E2.

When the compensation period $P_{CP}$ begins, the control signals G2[i] and G3[i] change to the low level to thereby turn off the light-emission control transistors Qel of the element sections U1 and U2. Therefore, by the time when the end of the compensation period $P_{CP}$ has arrived, the voltage at the gate of the driving transistor Qdr of each of the element sections U1 and U2 reaches to a difference value ($V_{EL}$-$V_{th}$)

between the power supply potential $V_{EL}$ of the power supply line 17 and a threshold voltage $V_{th}$ of the driving transistor Qdr.

When the scanning signal G[i] changes to the high level after the lapse of the compensation period $P_{CP}$, the selection transistors Qsl are turned on, and the voltage at the electrodes Ec2 changes from the previous voltage value, i.e., $V_0$, to the voltage value $V_d$ of the data signal Sk[j]. The voltage value $V_d$ is set to a voltage value lower than the voltage value $V_0$ and corresponding to the gradation value D. Further, the control signal G1[i] changes to the low level to thereby release the diode connection of the driving transistors Qdr. Since the impedance at the gates of the driving transistors Qdr is sufficiently high, if the electrodes Ec2 decrease from the voltage value $V_0$ to the voltage value $V_d$ by a change amount $\Delta V(=V_0-V_d)$, the voltage at the electrodes Ec1 changes (decreases) from the voltage value $(V_{EL}-V_{th})$, which is designated during the compensation period $P_{CP}$, by a value of $\Delta V \cdot c1/(c1+c)$. That is, the gates of the driving transistors Qdr are set to a voltage $V_g$ given by Eq. (1) as follows:

$$V_g = V_{EL} - V_{th} - k \cdot \Delta V \quad \text{Eq. (1)}$$

where k=c1/(c1+c)

In the light-emission period $P_{EL1}$ during which the control signal G2[i] is maintained at the high level, the light-emission control transistor Qel of the element section U1 is turned on. In the light-emission period $P_{EL2}$, the light-emission control transistor Qel of the element section U2 is turned on. In the light-emission period $P_{ELk}$, therefore, a drive current $I_{EL}$ corresponding to the voltage at the gate of the driving transistor Qdr of the element section Uk is supplied to the electro-optical element Ek.

In the horizontal scanning period H during which the scanning signal G[i] is at the high level, the signal generating circuit 25 at the j-th column sets one of the data signals S1[j] and S2[j] to the voltage value $V_d$ corresponding to the gradation value D, and sets the other to the voltage value $V_0$. For example, when the data determining unit 241 determines that the gradation value D is within the range $R_L$, as shown in FIG. 12, the signal generating circuit 25 sets the data signal S1[j] to the voltage value $V_d$ (which has potential lower than the voltage value $V_0$) corresponding to the gradation value D, and sets the data signal S2[j] to the voltage value $V_d$ (equal to the voltage value $V_0$) for turning off the electro-optical element E2. When the gradation value D is within the range $R_H$, the signal generating circuit 25 generates the data signal S2[j] having a voltage value $V_d$ corresponding to the gradation value D and the data signal S1[j] having a voltage value $V_d$ (equal to the voltage value $V_0$) for turning off the electro-optical element E1.

When the gradation value D is within the range $R_L$, therefore, the electro-optical element E1 emits light at a brightness corresponding to the gradation value D while the electro-optical element E2 is turned off during a period from the beginning to the end of the light-emission period $P_{EL1}$. When the gradation value D is within the range $R_H$, the electro-optical element E2 emits light at a brightness corresponding to the gradation value D while the electro-optical element E1 is turned off during a period from the beginning to the end of the light-emission period $P_{EL2}$.

The gradation level of the electro-optical element Ek (which is a time integral value of the brightness (i.e., the amount of light emission)) is determined according to the brightness in the light-emission period $P_{ELk}$ and the time length of the light-emission period $P_{ELk}$. Since the light-emission period $P_{EL1}$ is set shorter than the light-emission period $P_{EL2}$, the gradation change rate of the electro-optical element E1 is lower than the gradation change rate of the electro-optical element E2. Therefore, the third embodiment can also achieve similar advantages to those of the first embodiment.

In a case where the driving transistors Qdr operate in a saturation region, the drive current $I_{EL}$ supplied to the electro-optical element Ek in the light-emission period $P_{ELk}$ is represented by Eq. (2) as follows:

$$\begin{aligned} I_{EL} &= (\beta/2)(V_{gs} - V_{th})^2 \\ &= (\beta/2)(V_{EL} - V_g - V_{th})^2 \end{aligned} \quad \text{Eq. (2)}$$

where β denotes the gain coefficient of the driving transistor Qdr, and $V_{gs}$ denotes the voltage between the gate and source of the driving transistor Qdr.

By substituting Eq. (1) into Eq. (2), Eq. (2) is modified as follows:

$$I_{EL} = (\beta/2)(k \cdot \Delta V)^2$$

That is, the drive current $I_{EL}$ supplied to the electro-optical element Ek does not depend on the threshold voltage $V_{th}$ of the driving transistor Qdr. According to the third embodiment, therefore, unevenness in the gradation of the electro-optical element Ek caused by variations in the threshed voltages $V_{th}$ of the driving transistors Qdr (deviation from a prescribed value or a difference from the other driving transistors Qdr) can be suppressed.

Fourth Embodiment

A fourth embodiment of the invention will be described.

In the first embodiment, a voltage programming method in which the gradation level of the electro-optical element Ek is determine according to the voltage value $V_d$ of the data signal Sk[j] is employed. In the fourth embodiment, a current programming method in which the gradation level of the electro-optical element Ek is determined according to a current value Id of the data signal Sk[j] is employed in combination with the voltage programming method. In the fourth embodiment, elements having the same or similar advantages and functions to those of the first embodiment are represented by the same reference numerals, and a detailed description thereof is appropriately omitted.

Figure 13:
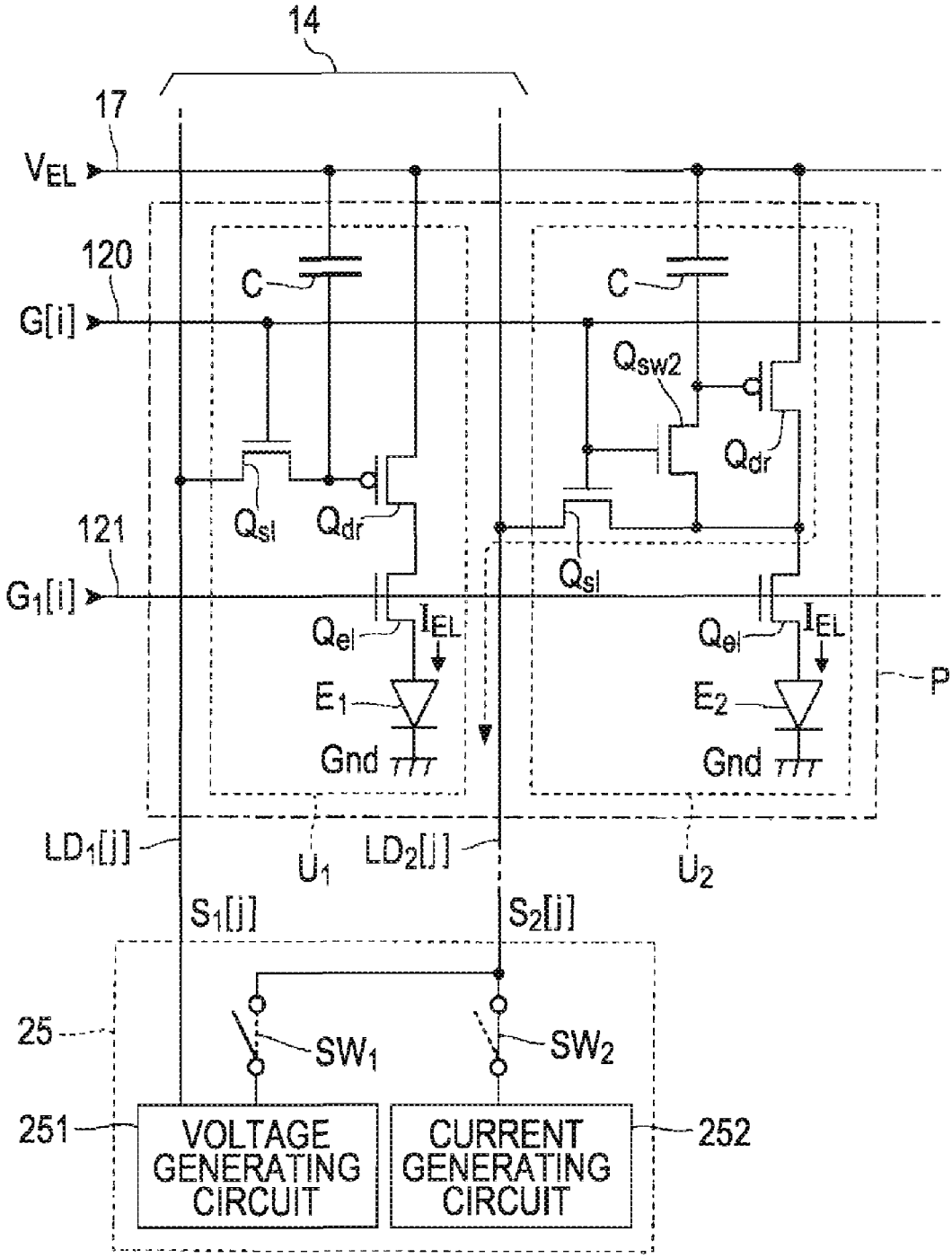
FIG. 13 is a circuit diagram showing the structure of a unit circuit according to a fourth embodiment of the invention.

FIG. 13 is a circuit diagram showing the structure of the unit circuit P at the j-th column in the i-th row. As shown in FIG. 13, the unit circuit P includes two element sections U1 and U2. The element section Uk (where k is 1 or 2 in the fourth embodiment) includes an electro-optical element Ek. As in the first embodiment, the gradation change rate of the electro-optical element E1 is lower than that of the electro-optical element E2 (for example, the area of the electro-optical element E2 is larger than that of the electro-optical element E1). In the fourth embodiment, as in the third embodiment, the electro-optical element E1 is driven when the gradation value D is within the low-gradation range $R_L$, and the electro-optical element E2 is driven when the gradation value D is within the high-gradation range $R_H$.

As shown in FIG. 13, the element array section A of the fourth embodiment includes a scanning line 120 and a control line 121 extending in parallel to the scanning line 120. The scanning line driving circuit 22 outputs a control signal G1[i] to the control line 121. The element section Uk includes a light-emission control transistor Qel between the drain of the driving transistor Qdr and the anode of the electro-optical element Ek. A control signal G1[i] is supplied from the control line 121 to the gates of the light-emission control transistors Qel in the element sections U1 and U2.

As in the first embodiment, the element section U1 includes a selection transistor Qsl between the gate of the driving transistor Qdr and the data line LD1[j]. The element section U2, on the other hand, includes a selection transistor Qsl between the drain of the driving transistor Qdr and the data line LD2[j]. The element section U2 further includes a transistor Qsw2 between the gate and drain of the driving transistor Qdr for controlling the electrical connection therebetween. A gate of the transistor Qsw2 is connected with the scanning line 120.

As shown in FIG. 13, each of the signal generating circuits 25 includes a voltage generating circuit 251, a current generating circuit 252, and switches SW1 and SW2. The switch SW1 of the signal generating circuit 25 at the j-th column is provided between the data line LD2[j] and the voltage generating circuit 251, and the switch SW2 is provided between the data line LD2[j] and the current generating circuit 252. The voltage generating circuit 251 is also connected with the data line LD1[j].

Figure 14A:
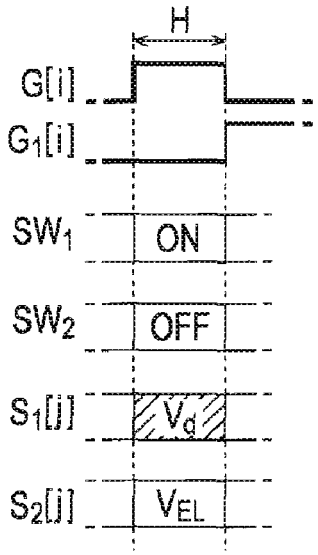
FIGS. 14A and 14B are timing charts showing the operation of the electro-optical device.
Figure 14B:
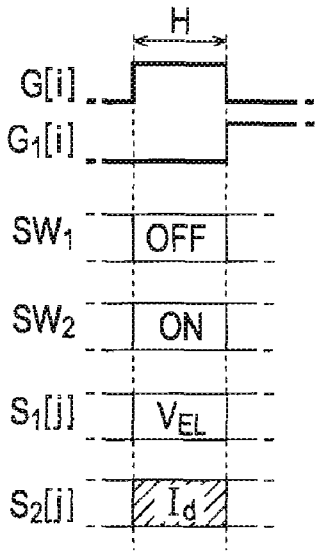

FIGS. 14A and 14B are timing charts showing the operation of the fourth embodiment. FIG. 14A shows the operation when a gradation value D within the low-gradation range $R_L$ is designated for the unit circuit P at the j-th column in the i-th row, and FIG. 14B shows the operation when a gradation value D within the high-gradation range $R_H$ is designated for the same unit circuit P. As shown in FIGS. 14A and 14B, the control signal G1[i] is set to a high level after the lapse of a horizontal scanning period H during which the scanning signal G[i] is at a high level.

When the data determining unit 241 determines that the gradation value D is within the range $R_L$, as shown in FIG. 14A, the signal generating circuit 25 turns on the switch SW1 and turns off the switch SW2 in the horizontal scanning period H during which the scanning signal G[i] is at the nigh level. When the gradation value D is within the range $R_H$, as shown in FIG. 14B, the signal generating circuit 25 turns off the switch SW1 and turns on the switch SW2 in the horizontal scanning period H.

When the gradation value D is within the range $R_L$, the voltage generating circuit 251 outputs a data signal S1[j] having a voltage value $V_d$ corresponding to the gradation value D, and outputs the power supply voltage $V_{EL}$ to the switch SW1. When the gradation value D is within the range $R_H$, the voltage generating circuit 251 outputs the power supply voltage $V_{EL}$ to the data line LD1[j]. The current generating circuit 252 outputs a current having the current value Id corresponding to the gradation value D to the switch SW2 when the gradation value D is within the range $R_H$, and stops outputting the current when the gradation value D is within the range $R_L$.

When the gradation value D is within the range $R_L$, therefore, as shown in FIG. 14A, the data signal S1[j] having the voltage value $V_d$ is output to the data line LD1[j], and the data signal S2[j] having the voltage value $V_{EL}$ is output to the data line LD2[j] via the switch SW1. When the gradation value D is within the range $R_H$, as shown in FIG. 14B, the data signal S1[j] having the voltage value $V_{EL}$ is output to the data line LD1[j], and the data signal S2[j] having the current value Id is output to the data line LD2[j] via the switch SW2.

As in the first embodiment, the data signal S1[j] is supplied to the gate of the driving transistor Qdr of the element section U1 when the selection transistor Qsl is turned on. Therefore, as shown in FIG. 14A, when the data signal S1[j] has the voltage value $V_d$, the electro-optical element E1 is controlled to the gradation level corresponding to the voltage value $V_d$ (i.e., the gradation value D) in the period during which the control signal G1[i] is at the high level, and, as shown in FIG. 14B, when the data signal S1[j] has the voltage value $V_{EL}$, the electro-optical element E1 is turned off.

In the horizontal scanning period H during which the scanning signal G[i] is turned on, the selection transistor Qsl and the transistor Qsw2 of the element section U2 are turned on. In the case shown in FIG. 14A, since the gate of the driving transistor Qdr is set to the voltage value $V_{EL}$ of the data signal S2[j] in the horizontal scanning period H, the electro-optical element E2 is turned off in the period during which the control signal G1[j] is at the nigh level. In the case shown in FIG. 14B, in the horizontal scanning period H, as indicated by a dotted arrow shown in FIG. 13, the data signal S2[j] having the current value Id flows from the power supply line 17 via the driving transistor Qdr and the selection transistor Qsl, and the voltage corresponding to the current value Id is held in the capacitor element C. The electro-optical element E2 is therefore controlled to the gradation level corresponding to the current value Id in the period during which the control signal G1[j] is at the high level.

According to the fourth embodiment, therefore, the electro-optical elements Ek having different gradation change rates are selectively driven according to the range R of the gradation values D, and similar advantages to those of the first embodiment, can also be achieved. Furthermore, in the fourth embodiment, when the gradation value D is high, the gradation level of the electro-optical element E2 is determined according to the current value Id of the data signal S2[j] (that is, the current programming method), whereas when the gradation value D is low, the gradation level of the electro-optical element E1 is determined according to the voltage value $V_d$ of the data signal S1[j] (that is, the voltage programming method). Therefore, even if the gradation value D is low, advantageously, the electro-optical element E1 can be reliably controlled to the gradation level corresponding to the gradation value D. The details of this advantage are described below.

The data line LDk[j] involves resistance and capacitance. When a low gradation level is specified (that is, when the current value Id is low), the current programming method has a problem in that a considerable amount of time is required to set the data signal Sk[j] to the current value Id corresponding to the gradation value D. In other words, if the time for supplying the data signal Sk[j] is insufficient, the gate of the driving transistor Qdr is not correctly set to the voltage corresponding to the gradation value D. In the fourth embodiment, in contrast, when the gradation value D is within the low-gradation range $R_L$, the voltage at the gate of the driving transistor Qdr is set using the voltage programming method. With this structure, the problem of insufficient writing of the voltage at the gate of the driving transistor Qdr can be overcome. Therefore, even if the data line LDk[j] has a high time constant, the electro-optical element E1 can be controlled to a predetermined gradation level with high accuracy.

Modifications

A variety of modifications can be made to the foregoing embodiments. Followings are specific modifications. The following modifications may be combined as necessary.

First Modification

In the first and second embodiments, the gradation change rates of the electro-optical elements Ek are different according to the conditions of the electro-optical elements Ek (such as the area of the electro-optical elements Ek and the thickness of layers). A variety of modifications may be made to a structure for designating different gradation change rates for the element sections U. More specifically, different gradation change rates may be designated for the element sections U by providing the same configuration for the electro-optical elements E1 to E3 included in each of the unit circuits P and selecting the characteristics of the driving transistors Qdr (the relationship between the voltage at the gates and the drive current $I_{EL}$) for each of the element sections U.

For example, in the structure of the first embodiment (see FIG. 2), if the same voltage is applied to the gates of the driving transistors Qdr of the element sections U1 to U3, the characteristics (such as the channel width and the channel length) of the driving transistors Qdr in the element sections U1 to U3 are determined so that the drive current $I_{EL}$ of the electro-optical element E1 is smaller than the drive current $I_{EL}$ of the electro-optical element E2 and the drive current $I_{EL}$ of the electro-optical element E2 is smaller than the drive current $I_{EL}$ of the electro-optical element E3. With this structure, similar advantages to those of the first and second embodiments can also be achieved.

In the embodiments of the invention, therefore, it is sufficient to provide a structure in which the gradation level (i.e., the gradation change rate) of the electro-optical element Ek differs from one element section U to another when data signals Sk[j] having the same level (such as the voltage value $V_d$ or the current value Id) are supplied to the element sections Uk, and there is no limit to a specific structure for achieving this difference in gradation level.

Second Modification

Figure 15:
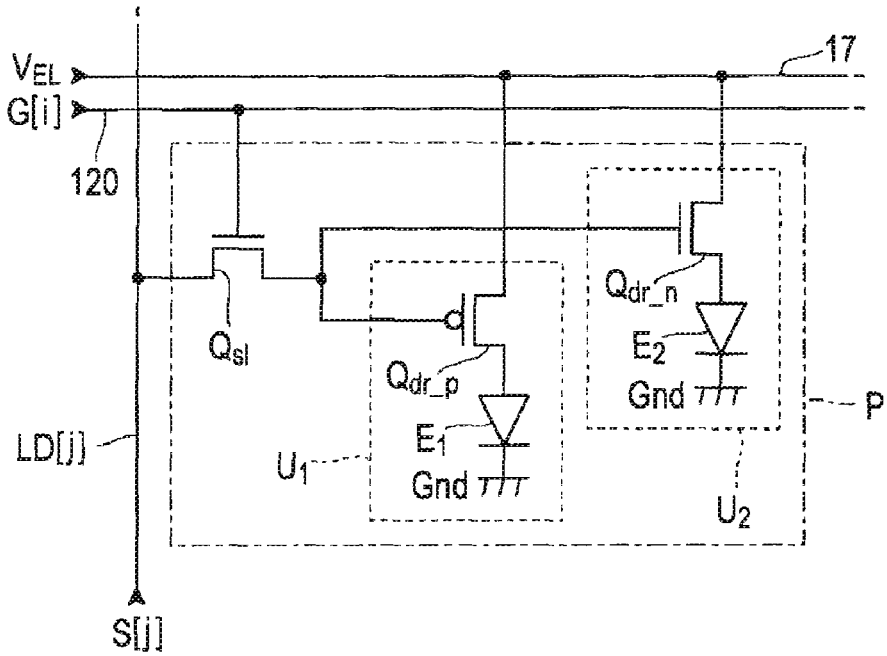
FIG. 15 is a circuit diagram showing the structure of a unit circuit according to a modification of the invention.

In the foregoing modifications, separate data signals Sk[j] are supplied to the element sections Uk. However, as shown in FIG. 15, one data line LD[j] (i.e., one data signal S[j]) can be shared between a plurality of element sections Uk in one unit circuit P. The unit circuit P shown in FIG. 15 includes element sections U1 and U2 and a selection transistor Qsl. The element section U1 includes a p-channel driving transistor Qdr_p that controls a drive current $I_{EL}$ supplied to an electro-optical element E1 according to the voltage at a gate of the driving transistor Qdr_p. The element section U2 includes an n-channel driving transistor Qdr_n that controls a drive current $I_{EL}$ supplied to an electro-optical element E2 according to the voltage at a gate of the driving transistor Qdr_n. The selection transistor Qsl is provided between the gates of the driving transistors Qdr_p and Qdr_n and the data line LD[j].

When the gradation value D is within the range $R_L$, the data signal S[j] supplied to the gates of the driving transistors Qdr_p and Qdr_n in the horizontal scanning period H during which the selection transistor Qsl is turned on is set to the voltage value $V_d$ corresponding to the gradation value D within the range that allows the driving transistor Qdr_p to be turned on. Therefore, while the drive current $I_{EL}$ corresponding to the gradation value D is supplied to the electro-optical element E1 from the driving transistor Qdr_p, the driving transistor Qdr_n is turned off, thereby turning off the electro-optical element E2. When the gradation value D is within the range $R_H$, the data signal S[j] set to the voltage value $V_d$ corresponding to the gradation value D within the range that allows the driving transistor Qdr_n to be turned on is supplied. Therefore, the electro-optical element E2 is controlled to the gradation level corresponding to the gradation value D, and the electro-optical element E1 is turned off. With the structure shown in FIG. 15, similar advantages to those of the foregoing embodiments can also be achieved by setting different gradation change rates for the element sections U1 and U2.

APPLICATION EXAMPLES

Figure 16:
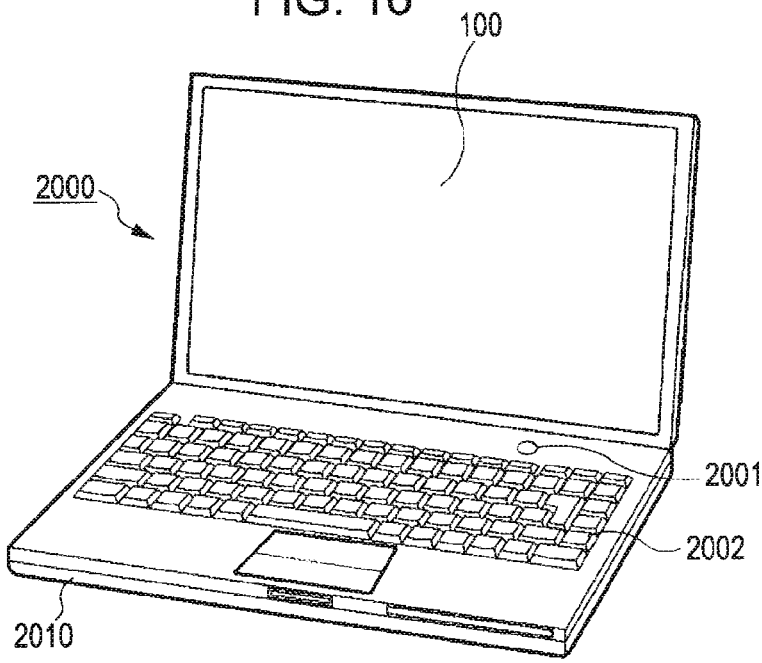
FIG. 16 is a perspective view showing an electronic apparatus (e.g., a personal computer) according to the invention.
Figure 17:
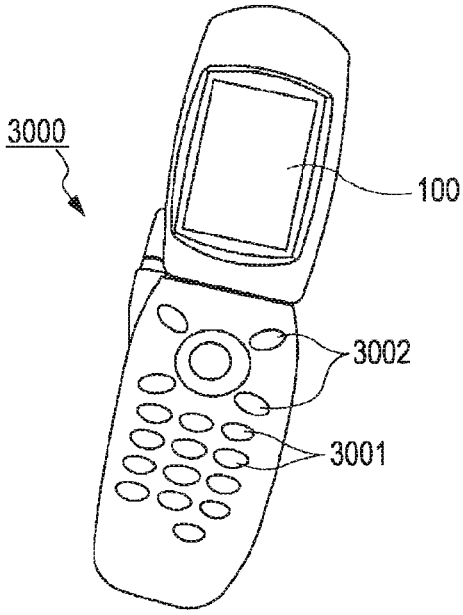
FIG. 17 is a perspective view showing an electronic apparatus (e.g., a mobile phone) according to the invention.
Figure 18:
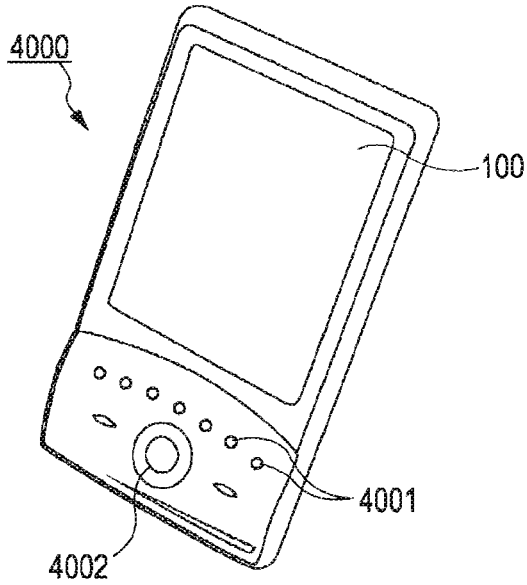
FIG. 18 is a perspective view showing an electronic apparatus (e.g., a portable information terminal) according to the invention.
Figure 19:
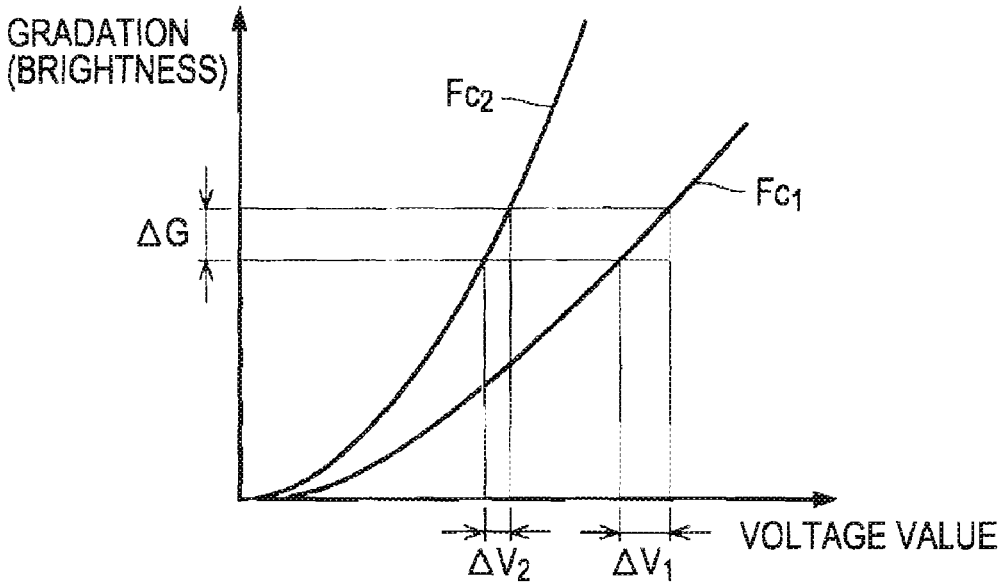
FIG. 19 is a graph showing the relationship between voltage values of a data signal and the gradation of an electro-optical element.
Figure 20:
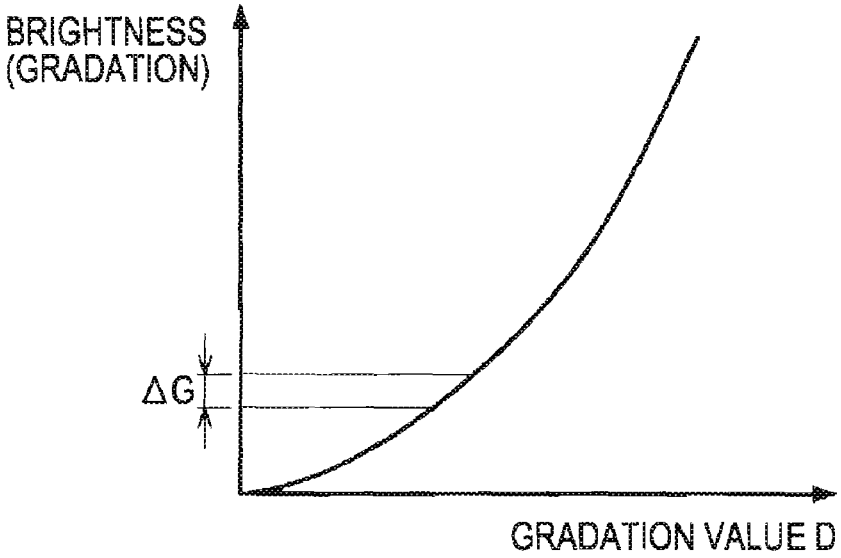
FIG. 20 is a graph showing the relationship between gradation values and the actual gradation of an electro-optical element.

An electronic apparatus including an electro-optical device according to the invention will be described. FIGS. 16 to 18 show electronic apparatuses including the electro-optical device 100 according to any of the embodiments and modifications described above as a display device.

FIG. 16 is a perspective view showing the structure of a mobile personal computer 2000 using the electro-optical device 100. The personal computer 2000 includes the electro-optical device 100 that displays various images, and a main body 2010 having a power supply switch 2001 and a keyboard 2002. Since OLED elements are used as the electro-optical elements E, the electro-optical device 100 can display an easy-to-read screen having a wide angle of view.

FIG. 17 is a perspective view showing the structure of a mobile phone 3000 using the electro-optical device 100. The mobile phone 3000 includes a plurality of operation buttons 3001 and scroll buttons 3002, and the electro-optical device 100 that displays various images. By operating the scroll buttons 3002, the screen displayed on the electro-optical device 100 can be scrolled.

FIG. 18 is a perspective view showing the structure of a personal digital assistant (PDA) 4000 using the electro-optical device 100. The PDA 4000 includes a plurality of operation buttons 4001, a power supply switch 4002, and the electro-optical device 100 that displays various images. By operating the power supply switch 4002, various types of information such as an address book or a schedule book are displayed on the electro-optical device 100.

Electronic apparatuses using an electro-optical device according to the invention include, not only the apparatuses shown in FIGS. 16 to 18, but also various electronic apparatuses such as digital still cameras, television sets, video camcorders, car navigation systems, pagers, electronic notebooks, electronic paper, electronic calculators, word processors, workstations, videophones, point-of-sale (POS) terminals, printers, scanners, copying machines, video players, and apparatuses equipped with touch panels. The use of the electro-optical device according to the invention is not limited to the display of images. For example, image forming apparatuses such as optical recording printers or electronic copying machines include an optical head (or recording head) that exposes a photosensitive member to light according to an image to be formed onto a recording material such as a sheet of paper, and an electro-optical device of the invention can be used as the optical head.

What is claimed is:

1. An electro-optical device comprising:

a unit circuit including:

a first element section that controls a first electro-optical element to a gradation level corresponding to a level of a data signal, and a second element section that controls a second electro-optical element to a gradation level corresponding to a level of a data signal, the gradation level of the first electro-optical element being lower than the gradation level of the second electro-optical element when data signals having an identical level are applied to the first element section and the second element section; and a signal generating circuit that generates data signals having different levels according to a gradation value specified for the unit circuit, wherein when the gradation value is within a first range, the signal generating circuit applies to the first element section a first data signal whose level is set so that the first electro-optical element is controlled to a gradation level corresponding to the gradation value, and when the gradation value is within a second range higher than the first range, the signal generating circuit applies to the second element section a second data signal whose level is set so that the second electro-optical element is controlled to a gradation level corresponding to the gradation value, and wherein a range of a voltage of the second data signal is narrower than a range of a voltage of the first data signal.

2. The electro-optical device according to claim 1, wherein the area of a region of the first electro-optical element from which light is output is different from the area of a region of the second electro-optical element from which light is output.

3. The electro-optical device according to claim 1, wherein the first and second electro-optical elements are light-emitting elements in which a light-emitting layer is inserted between first and second electrodes, and for the first and second electro-optical elements, an interval of the first electrode and the second electrode is different.

4. The electro-optical device according to claim 1, wherein the first and second electro-optical elements are light-emitting elements in which a light-emitting layer is inserted between a first electrode with light transparency and a second electrode with light reflectivity facing each other, and the thickness of the first electrode of the first electro-optical element is different from the thickness of the first electrode of the second electro-optical element.

5. The electro-optical device according to claim 1, further comprising an optically transparent insulation layer formed on a surface of a substrate, wherein the first and second electro-optical elements are light-emitting elements in which a light-emitting layer is inserted between the first electrode with light transparency formed on a surface of the insulation layer and the second electrode with light reflectivity facing the first electrode, and the thickness of a region of the insulation layer through which light output from the first electro-optical element is transmitted is different from the thickness of a region of the insulation layer through which light output from the second electro-optical element is transmitted.

6. The electro-optical device according to claim 1, further comprising:

a first light-transmitting member through which light output from the first electro-optical element is transmitted; and a second light-transmitting member through which light output from the second electro-optical element is transmitted, wherein the first light-transmitting member and the second light-transmitting member have different transmittances.

7. The electro-optical device according to claim 1, wherein:

each of the first and second element sections includes a driving transistor that generates a drive current corresponding to a gate voltage and that supplies the drive current to the electro-optical elements, and the drive current generated by a driving transistor of the first element section and the drive current generated by a driving transistor of the second element section have different current values when the same voltage is applied to the gate.

8. The electro-optical device according to claim 1, wherein the first element section controls the first electro-optical element to emit light at a brightness corresponding to the level of the data signal in a first period, and the second element section controls the second electro-optical element to emit light at a brightness corresponding to the level of the data signal in a second period longer than the first period.

9. The electro-optical device according to claim 1, wherein:

the first element section controls the first electro-optical element to a gradation level corresponding to a voltage value of the data signal;

the second element section controls the second electro-optical element to a gradation level corresponding to a current value of the data signal; and the signal generating circuit includes a voltage generating circuit that outputs a data signal having a voltage value corresponding to the gradation value specified for the unit circuit to the first element section when the gradation value is within the first range, and a current generating circuit that supplies a data signal having a current value corresponding to the gradation value to the second element section when the gradation value is within the second range.

10. An electronic apparatus comprising the electro-optical device according to claim 1.

* * * * *